US006630778B1

(12) United States Patent
Washiyama et al.

(10) Patent No.: US 6,630,778 B1
(45) Date of Patent: Oct. 7, 2003

(54) COLOR CRT AND PRODUCTION METHOD THEREFOR

(75) Inventors: Koji Washiyama, Saitama-ken (JP); Keisuke Iida, Saitama-ken (JP); Masaaki Inamura, Saitama-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/889,413

(22) PCT Filed: Jan. 20, 2000

(86) PCT No.: PCT/JP00/00243

§ 371 (c)(1),
(2), (4) Date: Jul. 17, 2001

(87) PCT Pub. No.: WO00/44023

PCT Pub. Date: Jul. 27, 2000

(30) Foreign Application Priority Data

Jan. 20, 1999 (JP) ..... 11-012044

(51) Int. Cl.[7] ..... H01J 29/10; H01J 9/26; H01J 9/12; B05D 9/26

(52) U.S. Cl. ..... 313/461; 313/466; 445/45; 445/47; 427/68

(58) Field of Search ..... 313/461, 466, 313/473, 112; 445/45, 47; 359/893; 430/27, 25, 26; 427/68

(56) References Cited

U.S. PATENT DOCUMENTS 5,173,636 A * 12/1992 Son ..... 313/466
5,952,776 A * 9/1999 Van Doorn et al. ..... 313/461

FOREIGN PATENT DOCUMENTS

| | | | |
|---|---|---|---|
| JP | 54-051458 | 5/1979 | |
| JP | 62-020217 | 1/1987 | |
| JP | 02-306525 | 12/1990 | |
| JP | 06-96668 | 4/1994 | |
| JP | 06096668 A * | 4/1994 | ..... H01J/9/22 |
| JP | 9-288972 | 11/1997 | |
| JP | 09-288972 | 11/1997 | |

* cited by examiner

*Primary Examiner*—Sandra O'Shea
*Assistant Examiner*—Peter Macchiarolo
(74) *Attorney, Agent, or Firm*—Oblon, Spivak, McClelland, Maier & Neustadt, P.C.

(57) ABSTRACT

A color cathode ray tube includes a transparent panel, a funnel joined airtightly to a circumference portion of a sidewall of the panel, a light absorption layer (black layer) and an optical filter layer both disposed on an interior surface of the transparent panel, and a phosphor layer formed thereon. A length from an edge of the panel joined to the funnel to a circumference edge of the light absorption layer formed on an interior surface of the sidewall of the panel is longer than or equal with that from the edge of the panel to a circumference edge of the optical filter layer formed similarly on an interior surface of the sidewall of the panel. The color cathode ray tube can be manufactured by making a length from an edge of the panel to a scraping edge of the light absorption layer in the trimming step of the light absorption layer longer than or equal with that from the edge of the panel to a scraping edge of the filter layer in the trimming step of the filter layer. Thus, black fragments occurring in trimming the optical filter layer can be prevented from adhering and remaining on the interior surface of the panel. Thereby, color cathode ray tubes without display defects can be realized.

6 Claims, 3 Drawing Sheets

COLOR CRT AND PRODUCTION METHOD THEREFOR

BACKGROUND OF THE INVENTION

1. Technical Field

The present invention relates to a color cathode ray tube having a luminescent surface with color filters and a manufacturing method thereof.

2. Background Art

In general, as shown in FIG. 6, on an interior surface of a panel 13 (face panel) of a color cathode ray tube 60, a phosphor screen 61 with phosphor layers of each color of blue (B), green (G) and red (R) are formed arranged in dots or in stripes. On each of these phosphor layers, an electron beam 62 output from an electron gun 63, and deflected by a deflector 64, is impinged to emit each corresponding color, thereby resulting in the display of images. Here, a panel 13 of a color cathode ray tube 60 is constituted of a faceplate with an exterior surface formed flat and a skirt portion (sidewall portion) connected thereto.

In such a color cathode ray tube, in order to absorb light from other than phosphors to improve contrast, between adjacent phosphor dots or phosphor stripes that are pixels, a light absorption layer (black layer) is disposed as black matrix.

The light absorption layer (the black layer) is formed, for instance, in the following way. First, on an interior surface of a glass panel, photo-resist is coated, followed by exposure through a shadow mask and development, to form a resist pattern arranged in dots or stripes. Thereafter, on a resulting structure a dispersion liquid of light absorbing material (black material) such as graphite is coated to be fixed on the resulting structure. Next, the surplus black layer adhered to the interior surface of the sidewall of the panel is scraped to be removed (generally referred to as trimming), followed by decomposition of the resist layer due to a resist decomposition agent such as an aqueous solution of hydrogen peroxide. Thereby, the resist layer is dissolved and peeled off as a whole including the black material adhered thereon.

Here, scraping of the surplus black layer adhered on the interior surface of the sidewall of the panel, that is trimming, is implemented in the following two ways. In one way, as shown in FIG. 2, by use of a rotary brush 11, the black layer is scraped or rubbed mechanically, followed by water washing. In the other way, as shown in FIG. 3, the black layer is dipped in a solution of decomposition agent 12 of the black material such as an aqueous solution of ammonium fluoride to chemically decompose the black layer. Thereby, the black layer is peeled off, followed by water washing. In these figures, reference numeral 13 denotes a panel, reference numeral 13*f* denotes a faceplate thereof, and reference numeral 13*s* denotes a sidewall, respectively. In addition, reference numeral 14 denotes the black layer (black matrix) formed in a prescribed pattern on the interior surface of the faceplate 13*f* of the panel and 14*s* denotes the surplus black layer adhered on the interior surface of the sidewall 13*s*.

Recently, in a color cathode ray tube, with an object to improve brightness and contrast of the luminescent surface, between the panel and phosphor layers, corresponding to each emission color of the respective phosphors, color filters (an optical filter layer) transmitting only the light of desired wavelength are disposed.

In order to form such an optical filter layer, for instance, on an interior surface of a panel thereon a black layer (black matrix) is formed and a dispersion liquid of pigment is coated to form a pigment layer, followed by coating photoresist thereon, exposing and development. By repeating this process, pigment layers of the respective colors are patterned in dots or in stripes. In the course of formation of such an optical filter layer, surplus pigment layers (filter layers) adhered on the interior surface of the sidewall of the panel, in the identical way as the black layer, are scraped to be removed (trimming). Reference numeral 15*s* denotes the surplus filter layer adhered on the interior surface of the sidewall 13*s* of the panel.

The reason why the trimming of the surplus black layer and surplus filter layer both adhered on the interior surface of the sidewall of the panel is necessary is as follows. After the phosphor layers are formed, a funnel 65 (FIG. 6) is joined airtightly by use of frit glass or the like to the sidewall portion of a panel 13. When the black layer or filter layer remains adhered in the neighborhood of an edge surface of the panel being joined to the funnel 65, in sealing, there is an inconvenience that cracks may occur at the portion connecting with the funnel 65.

Further, in detaching the mask in the step of later patterning, the surplus black layer or the filter layer may be rubbed by a mask-frame or a frame-holder to result in peeling off in certain cases. Thereby, peeled fragments tend to clog holes of the shadow mask. In order to prevent such an inconvenience from occurring, trimming is implemented onto the surplus layer of the interior surface of the sidewall of the panel.

However, in trimming such a black layer or optical filter layer, so far no particular attention has been paid to the lengths from an edge of the panel being joined to the funnel 65 to the peeling edges of the respective surplus layers (hereinafter refers as trimming dimension). It has thereby frequently occurred that, as shown in FIG. 4, the trimming dimension (a) of the black layer 14*s* is shorter than the trimming dimension (b) of the filter layer 15*s*.

In such cases, in trimming the filter layer 15*s*, the circumference portion of the surplus black layer 14*s* is likely to be scraped off again. Fragments of the black layer that are pulverized due to scraping by the rotary brush or fragments dissolved and peeled off due to immersion into an aqueous solution of ammonium fluoride enter into the interior surface of the faceplate 13*f* of the panel washing with water, and remain there without being completely removed. As a result of this, as shown in FIG. 5, a small fragment 16 of the black layer may result in a display defect. In FIG. 5, reference numeral 17 denotes an interior surface of the faceplate 13*f* and 18 denotes a black layer formed in a stripe as the black matrix.

Thus, the fragment 16 of the black layer entered into the interior surface 17 of the faceplate, in washing with water during trimming of the filter layer, for instance, can be removed by increasing an amount of washing water up to 20 to 30 l/min. In such a case, while the display defect due to the residual fragments of the black layer can be reduced, the filter layer is likely to be peeled off due to the water washing. Thereby, increasing the amount of washing water is difficult to put to practical use.

In trimming the black layer, the small fragments of the black layer peeled and pulverized by the rotary brush or dissolved and peeled in an aqueous solution of ammonium fluoride may come into the interior surface of the panel in washing with water. In such cases, since the small fragments of the black layer do not remain, no problem occurs. This is because the fragments of the black layer that intrude into the interior surface during the step of trimming of the black layer can be completely removed in the course of following steps of dissolving and peeling of the resist layer or the like.

SUMMARY OF THE INVENTION

The objects of the present invention are to provide a color cathode ray tube that can prevent fragments of black layer, which occur in trimming an optical filter layer, from adhering and remaining on an interior surface of a panel to give a defect-less display, and to provide a method for manufacturing such color cathode ray tubes with high yield.

A first aspect of the present invention is a color cathode ray tube, the color cathode ray tube comprising a transparent panel, a funnel joined airtightly to a circumference portion of a sidewall of the panel, a light absorption layer and an optical filter layer disposed on an interior surface of the panel, and a phosphor layer formed on the optical filter layer. Here, a length from an edge of the panel joined to the funnel to a circumference edge of the light absorption layer formed on an interior surface of the sidewall of the panel is longer than or equal to the length from the edge of the panel joined to the funnel to a circumference edge of the optical filter layer formed on the interior surface of the sidewall of the panel.

A second aspect of the present invention is a manufacturing method of a color cathode ray tube, the method for manufacturing the color cathode ray tube comprising the steps of forming a light absorption layer on an interior surface of a transparent panel, forming an optical filter on an interior surface of the panel on which the light absorption layer is formed, forming a phosphor layer (71R, 71G, 71B) of each color on the corresponding optical filter layer (72R, 72G, 72R) with an arrangement of a prescribed pattern, and joining a funnel airtightly to a circumference portion of the sidewall of the panel (FIG. 7). Here, the step of forming the light absorption layer comprises the steps of forming a resist layer of a prescribed pattern on the interior surface of the panel; of coating on the resulting structure a dispersion liquid of light absorption material to be fixed on the resulting structure; of scraping and removing surplus light absorption layer adhered on an interior surface of the sidewall of the panel as a trimming; and of dissolving the resist layer to be peeled off and removed together with the light absorption layer formed thereon. Here, the step of forming the optical filter layer comprises the steps of forming a filter layer of a plurality of colors with a prescribed pattern on the interior surface of the panel; and of scraping and removing the surplus filter layer adhered on the interior surface of the sidewall of the panel as a trimming. Here, a length from an edge of the panel being joined to the funnel to a scraping edge of the light absorption layer in the trimming step of the light absorption layer is longer than or equal to a length from the edge of the panel to a scraping edge of the filter layer in the trimming step of the filter layer.

In the following, the present invention will be described in more detail.

In a color cathode ray tube of the present invention, as shown in FIG. 1, a length (a) from a joined edge 2 with a funnel (not shown in the figure) of a panel 1 to a circumference edge of a light absorption layer (black layer) 3 adhered and formed on an interior surface of a sidewall 1*s* of the panel 1 is longer than or equal to a similar length (b) of an optical filter layer 4 ($a \leqq b$). A black layer 3 and a filter layer 4 constituted with such a structure can result in the following way. That is, in the trimming step of the surplus black layer 3 adhered onto the interior surface of the sidewall 1*s* of the panel 1, a length (trimming dimension) (a) from the edge 2 of the panel to a scraping edge of a black layer 3 is made longer than or equal with a trimming dimension (b) of a filter layer 4 in the trimming step of the surplus filter layer 4.

When constituted with such a structure, in the trimming step of the filter layer 4, the black layer 3 is not further scraped. Accordingly, fragments of the black layer 3 do not enter into and remain on the interior surface of the panel 1 (faceplate) thereby resulting in a color cathode ray tube of excellent image quality with no display defects. In addition to this, there is no need to increase the degree of water washing more than normal, and thus deterioration of yield due to peeling off of the filter layer 4 can be prevented from occurring.

In addition, in the present invention, by the following reasons, it is more desirable to make the trimming dimension (a) of the black layer 3 longer ($a>b$) than that (b) of the filter layer 4 rather than equalizing ($a=b$) them so that the upper filter layer 4 completely covers the circumference portion of the lower black layer 3. That is, in trimming, there are limits of accuracy in setting the panel 1 on a carrier and in disposing a device for trimming. Accordingly, it is difficult to set the trimming dimension of the panel 1 accurately to be equal over the entire circumference of the panel 1. When the trimming dimension of the black layer 3 and that of the filter layer 4 are set equal ($a=b$), there may still be portions of the lower black layer 3 that are not covered by the upper filter layer 4. In trimming the filter layer 4, the circumference edge of the black layer 3 may be partly trimmed again. Accordingly, in order to completely prevent the fragments of the black layer from entering and remaining on the interior surface of the panel, taking safety factors into consideration, it is desirable to set $a>b$.

In the present invention, in trimming the black layer or filter layer, scraping with a rotary brush or immersing in liquid of decomposing agent such as an aqueous solution of ammonium fluoride is implemented. In scraping by use of a rotary brush, from durability of the brush or accuracy of the device, the scraped edge portion may become wavy, that is, an identical trimming dimension cannot be obtained over the entire circumference. Further, in trimming the filter layer, the lower black layer may be scraped due to the rotary brush. Accordingly, it is desirable for the trimming to use immersing in an aqueous solution of decomposition agent such as ammonium fluoride to dissolve and peel the surplus black layer and the filter layer, followed by washing with water.

DESCRIPTION OF THE PREFERRED EMBODIMENTS

In the following, preferable embodiments of the present invention will be described. The present invention is not restricted to the following embodiments.

Embodiment 1

On interior surfaces of glass-panels of 21 inch and 32 inch, known photo-resist was coated, followed by exposure through a shadow mask, development, and drying. Thereby, a resist pattern was formed in stripes on the positions where a pigment layer and a phosphor layer were being formed later. Then, on the entire surface on the resist pattern, an aqueous solution of 5% by weight of Aquadag (product of Achison Co.) was coated, followed by heating with a heater for a fixing. Thereafter, with a rotary brush rotating with a speed of approximately 200 rpm, a surplus black layer fixed on an interior surface of a sidewall of the panel was trimmed away over a range of 16 mm (trimming dimension a) in a direction of the faceplate from an edge of the sidewall. Thereafter, the interior surface of the panel was washed with water to wash away fragments of the black layer generated by the trimming.

Next, the resist layer was dissolved and peeled off by use of an aqueous solution of hydrogen peroxide. Thereby, the black layer formed on the resist layer was peeled off and removed to form the black layer (thickness; 0.5–1.5 $\mu$m) in stripe.

Thus, after forming the black matrix, defect inspection of the display surface was carried out. The inspection of display defects was implemented by visual inspection in an actual manufacturing line. Incidence of failure due to residual fragments of the black layer on the interior surface of the faceplate was evaluated. The results of the inspection are shown in Table 1.

Figure 1:
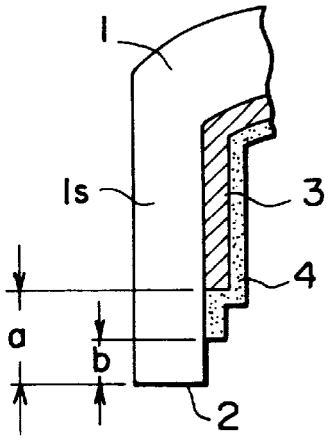
FIG. 1 is a cross-section schematically showing a structure of a sidewall of a panel in a color cathode ray tube of the present invention.
Figure 2:
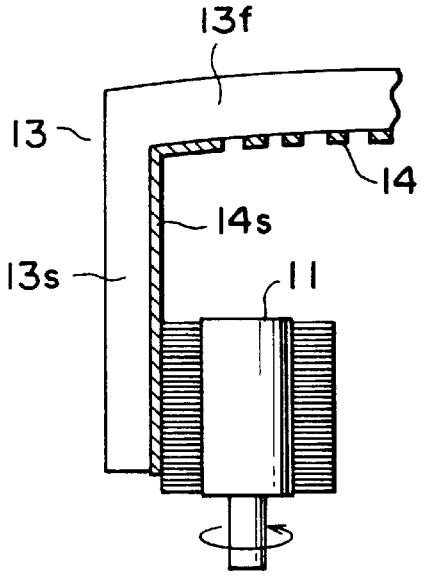
FIG. 2 is a diagram showing a method of trimming a surplus layer due to a rotary brush.
Figure 3:
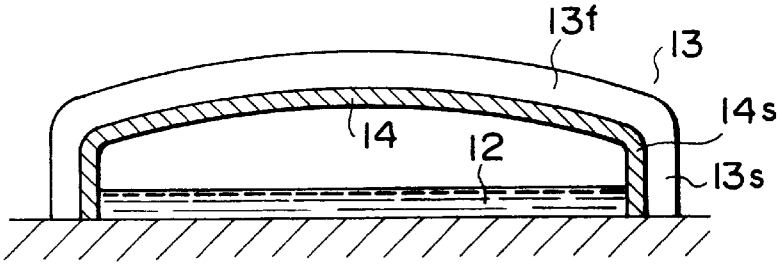
FIG. 3 is a diagram showing a method of trimming a surplus layer due to immersion into a solution of decomposition agent.
Figure 4:
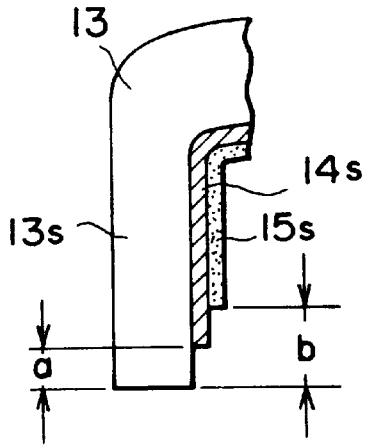
FIG. 4 is a cross-section showing a structure of a sidewall of a panel in an existing color cathode ray tube.
Figure 5:
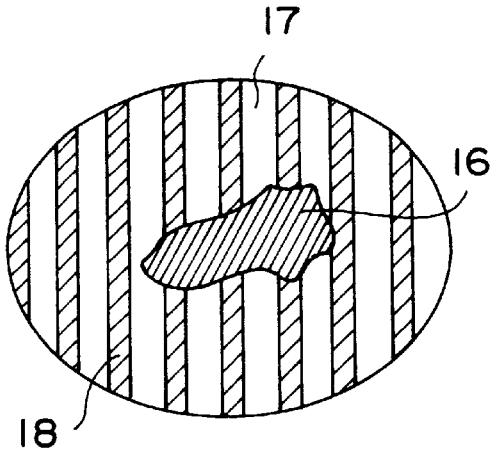
FIG. 5 is a diagram showing in enlargement a display defect due to residual fragment of black layer.
Figure 6:
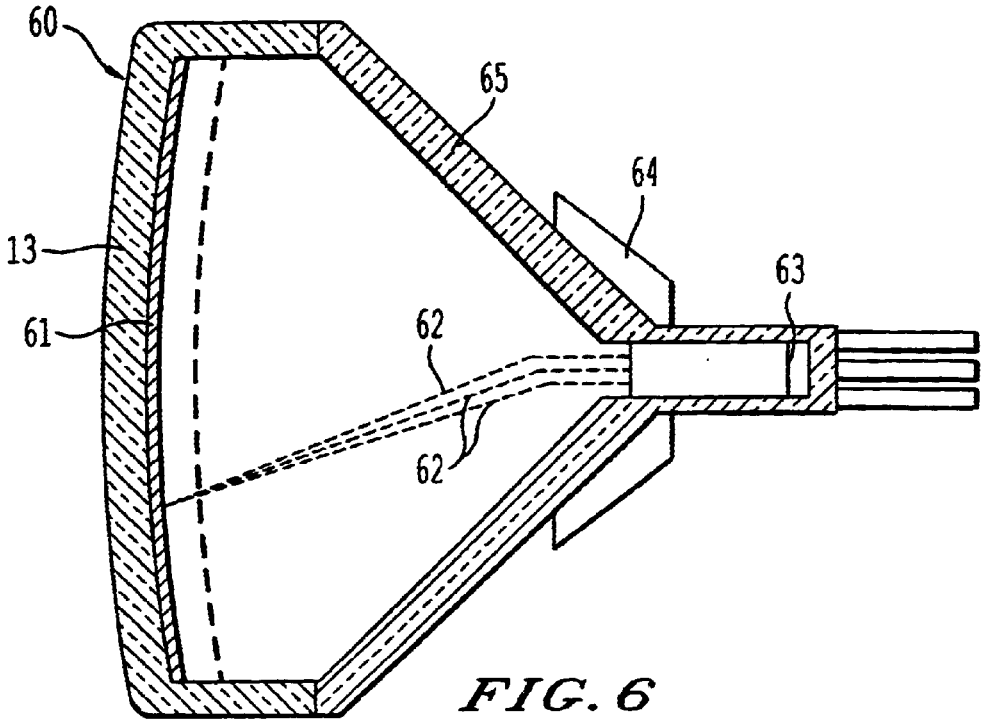
FIG. 6 PRIOR ART
FIG. 6 is a cross-section schematically showing a structure of a background color cathode ray tube.
Figure 7:
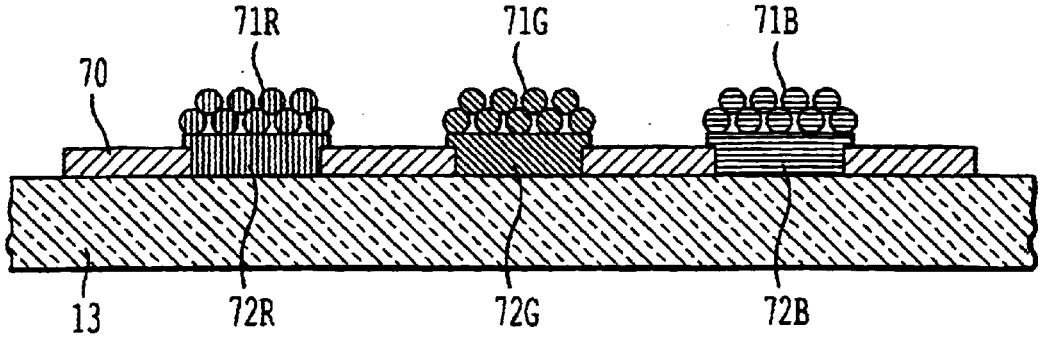
FIG. 7 is a cross-section showing a structure of a phosphor screen of the color cathode ray tube according to the present invention.

Next, and as shown in FIG. 7, on the interior surface of the glass panel 13 thereon the black matrix 70 had been thus formed, a blue pigment layer 72B comprising cobaltous aluminate, a green pigment layer 72G comprising cobalt green and a red pigment layer 72R comprising iron red were arranged in stripes, respectively, by use of a known method. Thereby, an optical filter layer 72R, 72G, 72B (thickness; 0.1–1.5 $\mu$m) was formed.

In the course of formation of the optical filter layer, after the red pigment layer was formed, with a rotary brush of speed of approximately 200 rpm, a surplus filter layer (pigment layers) fixed on the interior surface of the sidewall of the panel was trimmed away in a direction of the faceplate over the range of 13 mm (trimming dimension b) from the edge of the sidewall. Thereafter, the interior surface of the panel was washed with water. Even after the optical filter layer was thus formed, an inspection for display defects due to residual black layer was similarly carried out. The results of the inspection are shown in Table 1.

Further, for comparison purpose, with glass panels of 21 inch and 32 inch, in the identical procedure with Embodiment 1, with the trimming dimension (a) of the black layer of 13 mm and the trimming dimension (b) of the filter layer of 16 mm, the black matrix and the optical filter layer were formed in turn. Then, after formation of the black matrix and the optical filter layer, inspections for display defects due to residual black layer were carried out, respectively. The results of the inspections are shown in Table 1 as comparative examples.

As obvious from Table 1, in the comparative examples that were constituted so that the trimming dimension (a) of the black layer was shorter than the trimming dimension (b) of the filter layer (a<b), for both 21 inch panels and 32 inch panels, incidence of failure (display defects) in which fragments of black layer adhered and remained on the interior surface of the panel could not be observed after formation of the black layer. However, after formation of the optical filter layer, approximately 1% of incidence was observed for the 21-inch panels and approximately 3% of incidence for the 32-inch panels.

On the other hand, in embodiment 1 that was constituted so that the trimming dimension (a) of the black layer was longer than the trimming dimension (b) of the filter layer (a>b), incidences of the display defects, for both 21-inch panels and 32-inch panels, were not observed after formation of the black layer. Further, after formation of the optical filter, the incidences became approximately 0.1% for 21-inch panels and approximately 0.15% for 32-inch panels. The incidence of embodiment 1 was improved to approximately less than 1/10 of that in the comparative example.

The reason for the difference of incidence of the display defects between 21-inch panel and 32-inch panel is considered to be as follows. The 32-inch panel is much larger in its area than that of 21-inch panel and is likely to result in occurrence of more fragments of the black layer in trimming the filter layer thereof. Accordingly, an amount of water that can wash away the 21-inch panel is not sufficient to wash away the 32-inch panel.

Next, and as shown in FIG. 7, on the optical filter layer thus formed according to embodiment 1, the respective phosphor layers 71R, 71G, 71B of each color were formed in turn by use of the ordinary slurry coating method so that a blue phosphor 71B layer was disposed on a blue pigment layer 72B, a green phosphor layer 71G on a green pigment layer 72G, and a red phosphor layer 71R on a red pigment layer 72B.

Here, for the phosphor slurry, the following was used. That was, for the blue phosphor slurry, 100 g of blue emitting phosphor (ZnS: Ag, Al), 5 g of polyvinyl alcohol (PVA), 0.30 g of ammonium dichromate (ADC), 0.01 g of surfactant, and 140 g of pure water were mixed and agitated to prepare slurry. For the green phosphor slurry, 100 g of green emitting phosphor (ZnS: Cu, Al), 8 g of PVA, 0.40 g of ADC, 0.01 g of surfactant, and 160 g of pure water were mixed and agitated to prepare slurry. Further, for the red phosphor slurry, 100 g of red emitting phosphor ($Y_2O_2S$: Eu), 10 g of PVA, 0.50 g of ADC, 0.01 g of surfactant, and 190 g of pure water were mixed and agitated to prepare slurry.

In a luminescent surface of a color cathode ray tube thus obtained, the black layer and the filter layer were prevented from peeling, adhering or mixing with the other colors. Thereby, a display of excellent quality and of high contrast could be realized.

Embodiment 2

A black layer (black matrix) was formed in stripes identically with embodiment 1 except that instead of with a rotary brush, the trimming was carried out by being immersed in an aqueous solution containing 5% of ammonium fluoride (by mass %) and 1% of PVA (NIHON GOSEI KAGAKU; GOHSENOL EG40) that was a binder, followed by water washing. Then, an optical filter layer was formed thereon. Trimming of the surplus filter layer in the process of formation of the optical filter layer was implemented identically as in embodiment 1 with a rotary brush. As identical with embodiment 1, the trimming dimension of the black layer (a) was 16 mm, and the trimming dimension of the filter layer (b) 13 mm. After formation of the black matrix and after formation of the optical filter, any display defects due to the residue of the black layer were inspected for, respectively. The results are shown in Table 1.

Embodiment 3

In both processes of formation of the black layer and of the optical filter, instead of the rotary brush, immersion into an aqueous solution of 5% of ammonium fluoride and 1% of PVA followed by water washing was implemented for trimming the black layer and the filter layer, respectively. Embodiment 3 was identical with embodiment 1 except that the black layer (black matrix) was formed in stripes and thereon the optical filter layer was formed. The trimming dimensions (a) and (b) of the black layer and the filter layer were, identically with embodiment 1, 16 mm and 13 mm, respectively. After formation of the black matrix and after formation of the optical filter, any display defects due to the residue of the black layer were inspected for, respectively. The results are shown in Table 1.

TABLE 1

| | | | Embodiment 1 | Embodiment 2 | Embodiment 3 | Comparative example |
|---|---|---|---|---|---|---|
| Method of trimming | | Black layer | Rotary brush | Ammonium fluoride solution | Ammonium fluoride solution | Rotary brush |
| | | Optical filter layer | Rotary brush | Rotary brush | Ammonium fluoride solution | Rotary brush |
| Incidence of failure (%) | After BM formation | 21-inch panel | 0 (0/2,550) | 0 (0/15,010) | 0 (0/50,157) | 0 (0/12,521) |
| | | 32-inch panel | 0 (0/1,260) | 0 (0/7,200) | 0 (0/3,870) | 0 (0/5,750) |
| | After optical filter formation | 21-inch panel | 0.1 (3/2,470) | 0.05 (8/14,900) | 0 (0/50,120) | 1 (123/12,480) |
| | | 32-inch panel | 0.15 (2/1,240) | 0.I (7/7,150) | 0 (0/3,853) | 3 (173/5,750) |

Numbers in brackets denote ratios of number of failure/number of inspection.

As obvious from Table 1, in embodiment 2, for both 21-inch panels and 32-inch panels, after formation of the black layer, no occurrence of display defects (failures) were observed due to the adherence and residue of fragments of the black layer. After formation of the optical filter layer, for the 21-inch panels, the incidence was approximately 0.05%, and for 32-inch panels approximately 0.1%. Thus, it was found that the display quality was improved further from that of embodiment 1.

Further, in Embodiment 3, the identical display defects were not observed to occur for both 21-inch panels and 32-inch panels after formation of the black layer. In addition, even after formation of the optical filter layer, the display defect rate was found to be zero.

As obvious from the aforementioned explanation, in the present invention, in the process of formation of the black layer, the dimension of trimming (trimming dimension) the surplus black layer adhered to the interior surface of the sidewall of the panel is made longer than or equal with that of the surplus filter layer adhered to the identical portions in the process of formation of the optical filter layer. Thereby, in trimming the filter layer, the black layer does not enter into the interior surface of the panel to adhere and remain. Accordingly, color cathode ray tubes of no display defect and of excellent image quality can be manufactured with high yield.

What is claimed is:

1. A color cathode ray tube (CRT), comprising:

a transparent panel;

a funnel joined airtightly to a circumference portion of a sidewall of the panel;

a light absorption layer and an optical filter layer disposed on an interior surface of the panel, the optical filter layer including a pigment; and a phosphor layer formed on the optical filter layer;

wherein a length from an edge of the panel joined to the funnel to a circumference edge of the light absorption layer formed on an interior surface of the sidewall of the panel is longer than or equal with that from the edge of the panel joined to the funnel to a circumference edge of the optical filter layer formed on the interior surface of the sidewall of the panel.

2. The color cathode ray tube as set forth in claim 1:

wherein a length from an edge of the panel joined to the funnel to a circumference edge of the light absorption layer formed on an interior surface of the sidewall of the panel is longer than that from the edge of the panel to a circumference edge of the optical filter layer formed on the interior surface of the sidewall of the panel.

3. A method of manufacturing a color cathode ray tube (CRT), comprising:

forming a light absorption layer on an interior surface of a transparent panel;

forming an optical filter including a pigment on an interior surface of the panel whereon the light absorption layer is formed;

forming a phosphor layer of blue, red, or green on the optical filter layer in a pattern; and joining a funnel airtightly to a circumference portion of the sidewall of the panel;

wherein forming the light absorption layer comprises forming a resist layer of prescribed pattern on the interior surface of the panel, coating thereon a dispersion liquid of light absorption material, scraping and removing surplus light absorption layer adhered on an interior surface of the sidewall of the panel to trim, and dissolving the resist layer to peel off and remove together with the light absorption layer formed thereon; and forming the optical filter layer comprises forming a filter layer of a plurality of colors with a prescribed pattern on the interior surface of the panel, and scraping and removing the surplus filter layer adhered on the interior surface of the sidewall of the panel to trim;

wherein a length from an edge of the panel being joined to the funnel to a scraping edge of the light absorption layer in the trimming step of the light absorption layer is longer than or equal with that from the edge of the panel to a scraping edge of the filter layer in the trimming step of the filter layer.

4. The method of manufacturing a color CRT as set forth in claim 3:

wherein a length from an edge of the panel being joined to the funnel to a scraping edge of the light absorption layer in the trimming step of the light absorption layer is longer than that from the edge of the panel to a scraping edge of the filter layer in the trimming step of the filter layer.

5. The method of manufacturing a color CRT as set forth in claim 3:

wherein the trimming of the light absorption layer comprises immersing the surplus light absorption layer into ammonium fluoride, followed by water washing.

6. The method of manufacturing a color CRT as set forth in claim 3:

wherein the trimming of the filter layer comprises immersing the surplus filter layer into ammonium fluoride, followed by water washing.

* * * * *

UNITED STATES PATENT AND TRADEMARK OFFICE

CERTIFICATE OF CORRECTION

PATENT NO. : 6,630,778 B1
DATED : October 7, 2003
INVENTOR(S) : Washiyama et al.

It is certified that error appears in the above-identified patent and that said Letters Patent is hereby corrected as shown below:

Title page, Item [54] and Column 1, lines 1-2,
Title should read:
-- [54] COLOR CRT AND METHOD OF MANUFACTURING THE SAME --

Signed and Sealed this

Thirtieth Day of December, 2003

JAMES E. ROGAN
*Director of the United States Patent and Trademark Office*